US009339122B2

(12) United States Patent
Frankel

(10) Patent No.: US 9,339,122 B2
(45) Date of Patent: May 17, 2016

(54) LID DISPENSER

(71) Applicant: Stuart Frankel, Miami, FL (US)

(72) Inventor: Stuart Frankel, Miami, FL (US)

(73) Assignee: Stuart Frankel, Miami, FL (US)

( * ) Notice: Subject to any disclaimer, the term of this patent is extended or adjusted under 35 U.S.C. 154(b) by 0 days.

(21) Appl. No.: 14/294,899

(22) Filed: Jun. 3, 2014

(65) Prior Publication Data

US 2014/0353331 A1 Dec. 4, 2014

Related U.S. Application Data

(63) Continuation-in-part of application No. 29/482,961, filed on Feb. 24, 2014, now Pat. No. Des. 727,056, and a continuation-in-part of application No. 29/482,963, filed on Feb. 24, 2014, now Pat. No. Des. 727,057.

(60) Provisional application No. 61/830,400, filed on Jun. 3, 2013.

(51) Int. Cl.
*A47F 1/00* (2006.01)
*A47F 1/08* (2006.01)

(52) U.S. Cl.
CPC ..... *A47F 1/085* (2013.01)

(58) Field of Classification Search
CPC ..... A47F 1/085; A47F 1/106
USPC ..... 221/242
See application file for complete search history.

(56) References Cited

U.S. PATENT DOCUMENTS

| | | | | | |
|---|---|---|---|---|---|
| 3,674,175 | A * | 7/1972 | Jaquish | 221/92 |
| 3,851,938 | A * | 12/1974 | McCowan et al. | 312/117 |
| 4,037,756 | A * | 7/1977 | Jaquish | 221/242 |
| 4,146,278 | A * | 3/1979 | Seitel | 312/35 |
| 4,643,334 | A * | 2/1987 | Steele | 221/63 |
| 5,038,969 | A * | 8/1991 | Berger | 221/40 |
| 5,127,546 | A * | 7/1992 | Chen | 221/242 |
| 5,131,562 | A * | 7/1992 | Brown | 221/41 |
| 5,845,791 | A * | 12/1998 | Kawolics | 211/49.1 |
| 6,406,107 | B1 * | 6/2002 | Franczak | 312/42 |
| 7,669,732 | B2 * | 3/2010 | Njaastad | 221/255 |
| 7,882,980 | B1 * | 2/2011 | Horn et al. | 221/226 |

* cited by examiner

*Primary Examiner* — Patrick Mackey
(74) *Attorney, Agent, or Firm* — Feldman Gale, P.A.

(57) ABSTRACT

A lid dispenser is provided for holding a stack of lids, which may be used with beverage containers. The lid dispenser includes a shaft, a lid deck which the stack of lids may rest on, and a gap from which a user of the lid dispenser may grasp and remove a lid. The shaft may extend to the front of the lid dispenser, or a screen may be provided. The screen may slidable along the shaft through engagement with one or more slots. An additional gate may be provided and independently slidable along the one or more slots. Multiple shafts may be included in a single lid dispenser in order to accommodate multiple lid sizes within a single dispenser.

4 Claims, 3 Drawing Sheets

LID DISPENSER

CROSS REFERENCE TO RELATED APPLICATIONS

This application is a continuation in-part of U.S. Design patent application No. 29/482,961 filed on Feb. 24, 2014, the entire contents of which is hereby incorporated herein by reference in its entirety. This application is also a continuation in-part of U.S. Design patent application No. 29/482,963 filed on Feb. 24, 2014, the entire contents of which is hereby incorporated herein by reference in its entirety. This application also claims the benefit of U.S. Provisional Application No. 61/830,400 filed on Jun. 3, 2013, the entire contents of which is hereby incorporated by reference in its entirety.

FIELD OF THE DISCLOSURE

This invention relates in general to units or apparatuses for holding and dispensing lids for a container.

BACKGROUND

Beverage containers sold in restaurant or fast food establishments often include lids for covering the container. Typical lids are plastic molded and snap-fit around the top rim or edge of a beverage container. As drink containers are sold in a variety of dimensions with the top rim of the container having a variety of possible circumferences, a variety of lids are necessarily manufactured to snap fit over a correspondingly dimensioned top rim of a container. Container lids are typically sold to vendors as a stack of lids having a common circumference.

Presently known and utilized lid dispensers are designed to simply hold a stack of lids so that a customer may pull a lid off or from the stack. The lids held in these dispensers, however, are exposed to the environment and are susceptible to contamination by an unsanitary user, particularly if the user touches multiple lids aside from the lid the user is attempting to select. Additionally, these lid dispensers often lead to a customer unintentionally removing multiple lids. It is common behavior that a user who unintentionally removes multiple lids will discard the extra or unintentionally removed lids, or worse yet for the establishment, will leave the lids lying about to collect until removed by an employee of the establishment.

More mechanically sophisticated lid dispensers have also been developed to protect lids from the environment as well as to prevent a user from removing multiple lids. Such previously improved lid dispensers typically rest a stack of lids on platform and, using a spring, press the platform towards an opening in the dispenser. These spring-loaded dispensers, however, have exceptional difficultly accommodating differently sized lids. Accordingly, an establishment may have to buy a new spring-loaded dispenser every time their container supplier changes the lid size on their containers. Spring-loaded lid dispensers are also more likely to mechanically fail due to their complexity. The result is that spring-loaded dispensers are quite costly and often disfavored by establishments. Accordingly, a need for a simpler yet more effective lid dispenser is greatly needed.

BRIEF SUMMARY OF THE DISCLOSURE

The following presents a simplified summary of the invention in order to provide a basic understanding of some aspects of the invention. This summary is not an extensive overview of the invention. Rather than specifically identify key or critical elements of the invention or to delineate the scope of the invention, its purpose, inter alia, is to present some concepts of the invention in a simplified form as a prelude to the more detailed description that is presented later.

In one embodiment a lid dispenser may include a substantially vertical shaft having a top end and a bottom end, the shaft sized and dimensioned to hold a plurality of lids arranged in a stack, the stack of lids insertable into the shaft at the top end; and a substantially planar deck provided transverse across a portion of the shaft proximate to the bottom end, a gap defined by the co-planar portion of the shaft in which the deck is not traversed across, the stack of lids resting on the deck, one of the plurality of lids on the deck graspable by a user through the gap.

In another embodiment a lid dispenser may include a plurality of elongate side walls defining a shaft, at least two opposing side walls having opposed slots extending longitudinally along at least a portion of the shaft; an elongate screen fittable into and slidable along the slots; and a deck provided transverse across the shaft and connected to at least one of the plurality of elongate side walls, a gap existing between the deck and the inserted elongate screen, wherein a stack of lids are insertable into the shaft and removable through the gap.

BRIEF DESCRIPTION OF THE FIGURES

The following description and the annexed drawings set forth certain illustrative aspects of the invention. These aspects are indicative of but a few of the various ways in which the principles of the invention may be employed and the present invention is intended to include all such aspects and their equivalents. Other advantages and novel features of the invention will become apparent from the following detailed description of the invention when considered in conjunction with the drawings.

DETAILED DESCRIPTION

Figures 1, 2, 3:
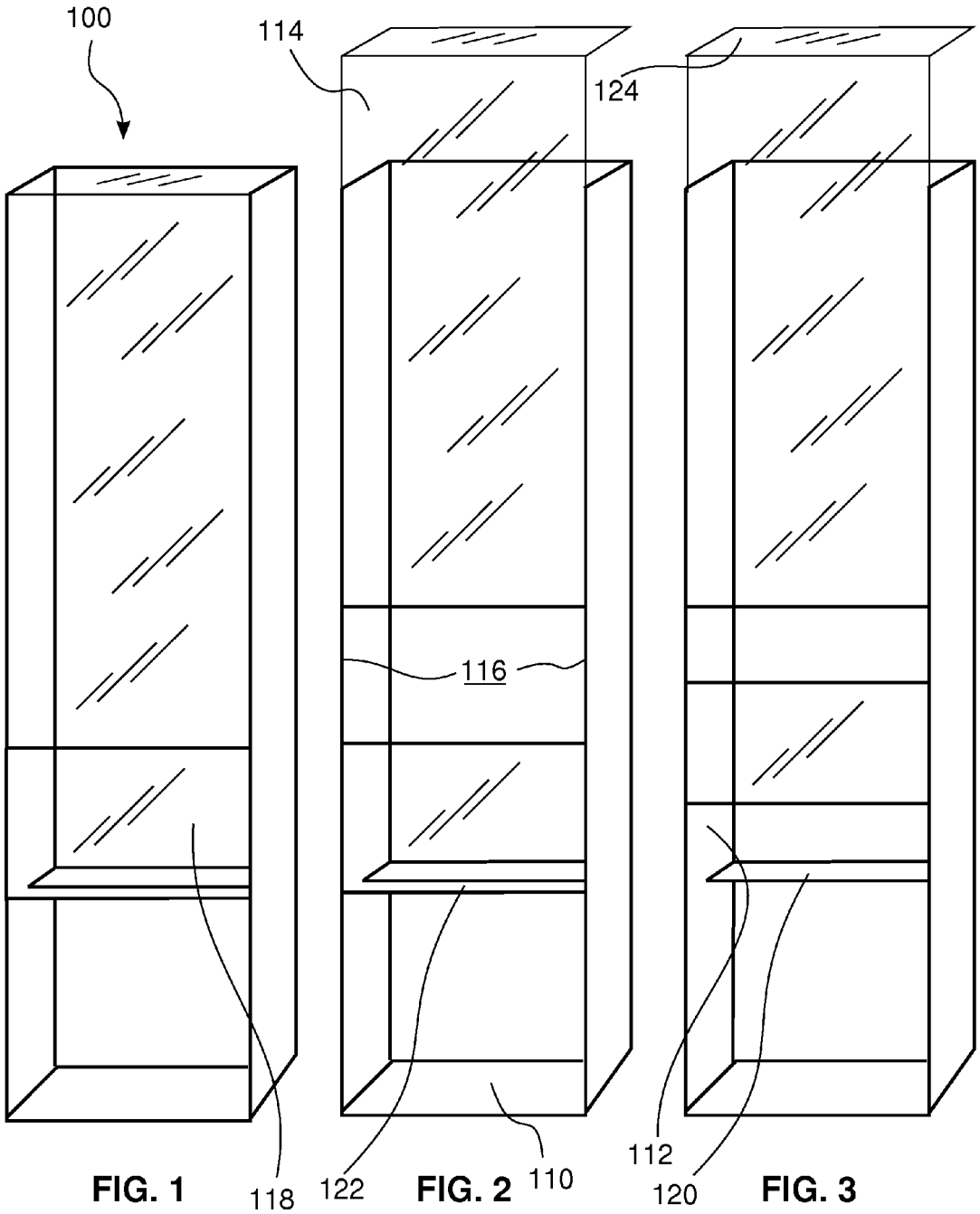
FIG. 1 is a front perspective view of an embodiment of a lid dispenser in a first position.
FIG. 2 is a front perspective view of the lid dispenser of FIG. 1 in a second position.
FIG. 3 is a front perspective view of the lid dispenser of FIG. 1 in a third position.
Figure 4:
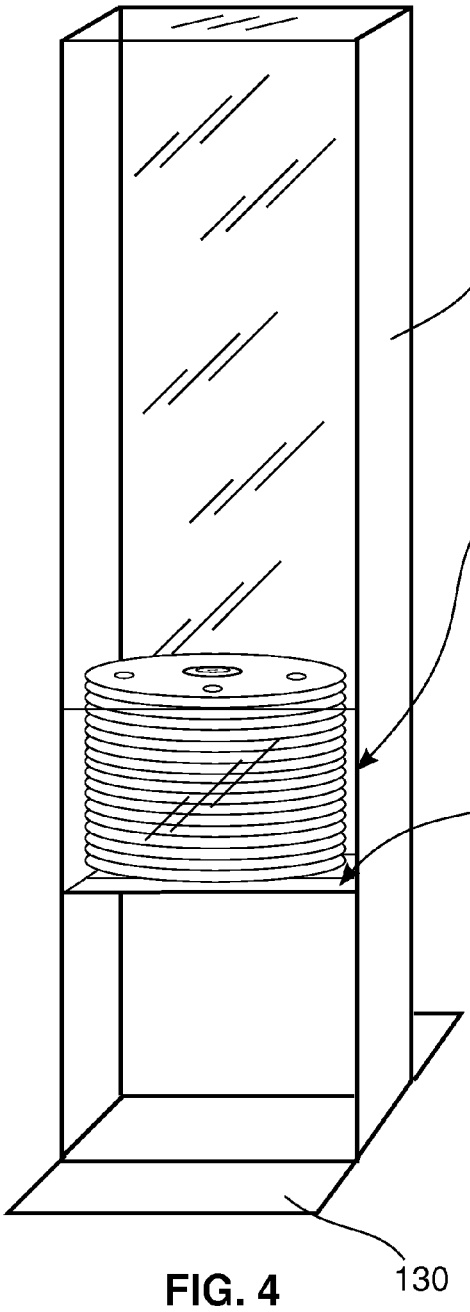
FIG. 4 is a front perspective view of an embodiment of a lid dispenser holding lids.

The following detailed description and the appended drawings describe and illustrate exemplary embodiments of the disclosure solely for the purpose of enabling one of ordinary skill in the relevant art to make and use the invention. As such, the detailed description and illustration of these embodiments are purely exemplary in nature and are in no way intended to limit the scope of the invention, or its protection, in any manner. It should also be understood that the drawings may not be to scale and in certain instances details may have been omitted, which are not necessary for an understanding of the present invention, such as conventional details of fabrication and assembly. These embodiments, which are also referred to herein as "examples," are described in sufficient detail to enable those skilled in the art to practice the subject matter disclosed herein. It is to be understood that the embodiments may be combined or that other embodiments may be utilized, and that structural, logical, and electrical variations may be made without departing from the scope of the subject matter disclosed herein. The following detailed description is, therefore, not to be taken in a limiting sense, and the scope of the subject matter disclosed herein is defined by the appended claims and their equivalents.

Throughout the disclosure, the terms "a" or "an" may refer to one or more than one. In this document, the term "or" is used to refer to a nonexclusive or, unless otherwise indicated. Furthermore, references to "one embodiment" are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

With reference now to FIGS. 1-5, a lid dispenser 100 includes a shaft 110 comprised of a plurality of shaft walls 112 for receiving a plurality of stacked lids 200, and a lid deck 120 provided proximate to the base of shaft 110, with the stacked lids 200 resting on lid deck 120. Lid deck 120 may be horizontal or substantially horizontal, such as angled slightly so as to accommodate removable of one of the stacked lids 110. In the illustrated embodiment, shaft 110 is comprised of three (3) shaft walls 112 and a screen 114, which may be clear and made from a plastic, glass, or similar material so that a customer may see the lids 200 stored within. Screen 114 may slide along guide tracks, grooves, or slits 116 provided on opposing shaft walls 112. Additional slits 116 may be provided for fitting deck 120 into shaft 110. Screen 114 may further include a top screen 124, which in some embodiments is an integral extension of screen 114. Top screen 124 may extend over and cover the upper portion of shaft 110 so as to shield the stored lids 200 from the environment. Lids 200 may then be inserted, or replaced, by raising screen 114/124 and inserting a stack of lids 200. Lids 200 may be inserted facing either upwards or downwards, although in the illustrated embodiment they are facing downwards as typical lid construction permits more flexibility, and thus separation between lids, when a lid is grabbed from underneath. In some embodiments, shaft 110 is formed into a rectangular shaft in order to accommodate lids of various sized diameters, as opposed to a circular shaft which may conform to a particular lid size but can only accommodate that particular lid size. In another embodiment shaft 110 is formed into a substantially circular shaft. A dispenser base 130 may be provided in order to stabilize dispenser 100.

A lid gate 118 may also be provided as a substantially co-planar material which separately slides along tracks 116 and is positioned below screen 114. FIGS. 2 and 3, for instance, illustrate the ability to separately slide screen 114 and gate 118 along tracks 116. In some embodiments, gate 118 may be connected to shaft 110 at hinges as opposed to tracks 116. For instance, gate 118 may swing outward along hinges and be secured against shaft 110 by a lock or other mechanism. Screen 114 may also be connected by hinges, anywhere along shaft 110, in some embodiments. Other known or to be developed means for connecting screen 114 or gate 118 are contemplated within the disclosure. In some embodiments, including the illustrated embodiments, screen 114 and gate 118 are removable from shaft 110, however in other embodiments either screen 114 or gate 118, or both, may be affixed to shaft 110 or integral with shaft 110. Lid gate 118 may be constructed in varying sizes, particularly varying heights, to restrict a customer's ability to grab more than one lid. Lid gate 118 may be constructed from substantially the same material as screen 114. Market observation indicates that customers tend to prefer to grab lids from the bottom of a stack, as opposed to the top, because there is often a customer perception that the bottom of the stack is less exposed to the environment, thus lid dispenser 100 is constructed to permit selecting lids from the bottom of stack 200. Screen 114 and top 124 also protect lid stack 200 from the environment, thereby decreasing the likelihood that a customer would waste a lid.

Figure 5:
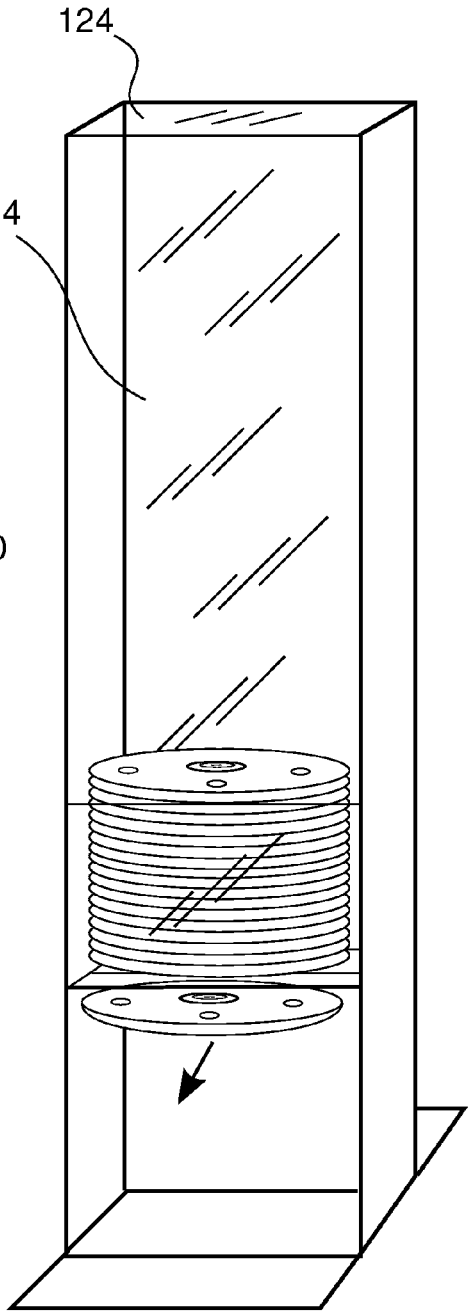
FIG. 5 is a front perspective view of the lid dispenser of FIG. 1 with a lid being removed.

In the illustrated embodiments, lid deck 120 is a substantially planar component oriented substantially horizontally or transverse across shaft 110, and deck gap 122 exists between gate 118 and deck 120. When a stack of lids 200 are placed in shaft 110, a user may grab a single lid at a time through deck gap 122. The lids 200 are fed downward shaft 110, by gravity, to replace a customer selected lid. As a user grabs and removes the lid 200 provided on the bottom of the lid stack, only a single lid 200 is removed due in part to the positioning of gate 118. As a user pulls a lid 200 away, the lid directly above the grasped lid contacts gate 118 which prevents the lid directly above the grasped lid from being removed as well as encouraging the grasped lid to separate from the lid directly above. The resulting effect is that only a single lid is removed at a time. FIG. 5 illustrates one embodiment of selecting a lid from lid dispenser 100. Shaft 110 may also be constructed at an angle, as opposed to the vertical orientation in the illustrated embodiments, so long as gravity is still forcing lids to replace one another at the base of shaft 110 proximate to deck 120. Depending on the size of lids 200, there can be an inside sleeve fittable around at least a portion of lids 200. A sleeve would be used if the dispenser is designed and dimensioned as a one size fits all lids 200.

Figure 6:
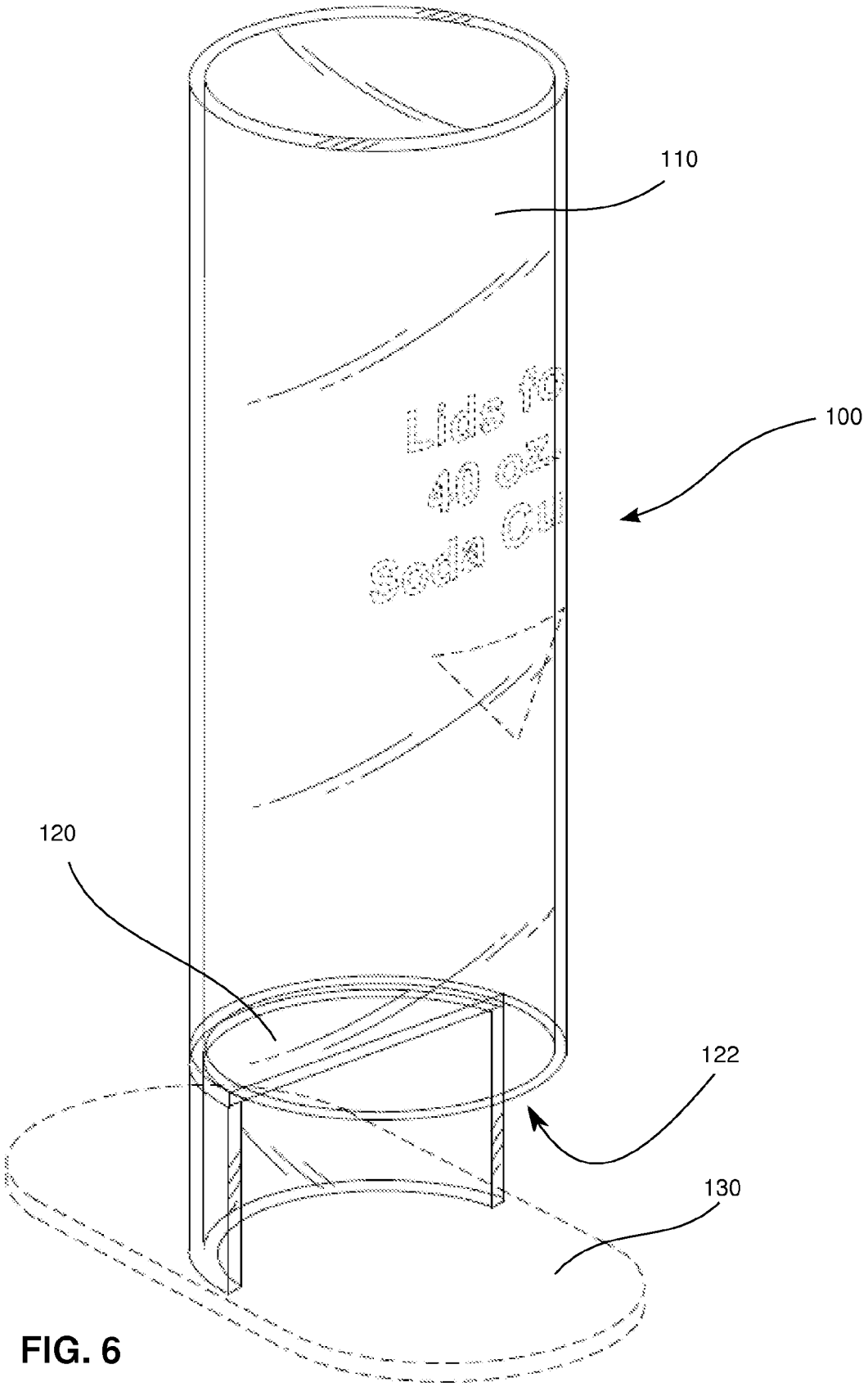
FIG. 6 is a front perspective view of an additional embodiment of a lid dispenser.

FIG. 6 illustrates an additional embodiment of lid dispenser 100 where shaft 110 is substantially cylindrical. Further depicted in FIG. 6 is that some embodiments of lid dispenser may not include either screen 114 or gate 118. Accordingly, shaft 110 may extend around the front side of dispenser 100 in lieu of either screen 114 or gate 118. The front side portion of shaft 110 may be removed proximate to gap 122, while the back side portion of shaft 110 may extend towards base 130. Lid deck 120 may be provided across a portion of shaft 110, with the portion not covered by lid deck 120 defining gap 122 from which a user may grasp a lid 200 stored within shaft 110. Top 124 is optional, and not illustrated in FIG. 6, but may replaceably secured to the end of shaft 110 by matable threading, friction fitting, or other known or to be developed methods and components for securing top 124 to the end of shaft 124.

Lid dispenser 100 may be constructed from any suitable components or materials. In one embodiment shaft 110 and lid deck 120 are constructed from the same materials, which may be steel or plastic. Components which are separately manufactured and subsequently assembled may be precision cut and attached by glue, welding, push or friction fitting, or other known or to be developed means.

The disclosure further contemplates additional shafts 110 as part of dispenser 100 in order to accommodate the simultaneous dispensing of multiple sized lids. An additional shaft, screen, gate, and/or deck may be placed on either side of shaft 110. In another embodiment, shaft 110 may have a second shaft behind shaft 110 for a second stack of lids 200. The rear deck may be positioned vertically below deck 120 so that a user may reach either lids associated with the front shaft 110 or the rear shaft.

The descriptions set forth above are meant to be illustrative and not limiting, and persons of skill in the art will recognize that various common and known deviations from the above described structures are considered to be within the scope of the disclosed concepts described herein.

What is claimed is:

1. A lid dispenser comprising:

a plurality of elongate side walls defining a shaft having a top end a bottom end, at least two opposing side walls having opposed slots extending longitudinally along at least a portion of the shaft;

an elongate screen fittable into and slidable along the slots, the elongate screen having a top end and a bottom end;

a deck provided at a height within the shaft and positioned transverse across the shaft, the deck connected to at least one of the plurality of elongate side walls, a gap existing between the deck and the bottom end of the fitted elongate screen; and a top screen provided as an extrusion to the screen, the top screen positioned to cover the top end of the shaft, wherein a stack of lids is insertable into the shaft and removable through the gap, and wherein the elongate screen is slidable such that the bottom end may be positioned at or proximate to the height of the deck.

2. The lid dispenser of claim 1, wherein the stack of lids is composed of a plurality of lids including a bottom lid contacting the deck when the stack of lids is inserted.

3. The lid dispenser of claim 1, wherein the screen is securable at a particular position in the slots.

4. A lid dispenser comprising:

a plurality of elongate side walls defining a shaft, at least two opposing side walls having opposed slots extending longitudinally along at least a portion of the shaft;

an elongate screen fittable into and slidable along the slots, the elongate screen having a top end and a bottom end;

a lid gate fittable into and slidable along the slots, the lid gate having a top end and a bottom end, the top end of the fitted lid gate provided adjacent to the bottom end of the fitted elongate screen and the lid gate and elongate screen independently slidable; and a deck provided at a height within the shaft and positioned transverse across the shaft, the deck connected to at least one of the plurality of elongate side walls, a gap existing between the deck and the bottom end of the fitted lid gate;

wherein a stack of lids is insertable into the shaft and removable through the gap, and wherein the lid gate is slidable such that the bottom end may be positioned at or proximate to the height of the deck.

* * * * *